US006722117B2

(12) United States Patent
Belcher, Jr. et al.

(10) Patent No.: US 6,722,117 B2
(45) Date of Patent: Apr. 20, 2004

(54) APPARENT TWIST YARN SYSTEM AND APPARATUS AND METHOD FOR PRODUCING SAME

(75) Inventors: Arnold L. Belcher, Jr., Bristol, TN (US); Lawrence E. Rasnick, Jr., Bristol, VA (US)

(73) Assignee: Prisma Fibers, Inc., Bristol, VA (US)

( * ) Notice: Subject to any disclaimer, the term of this patent is extended or adjusted under 35 U.S.C. 154(b) by 69 days.

(21) Appl. No.: 09/899,995

(22) Filed: Jul. 9, 2001

(65) Prior Publication Data

US 2002/0029554 A1 Mar. 14, 2002

Related U.S. Application Data

(60) Provisional application No. 60/218,045, filed on Jul. 13, 2000.

(51) Int. Cl.[7] ..... D01H 1/115

(52) U.S. Cl. ..... 57/205; 57/244; 57/246; 57/289; 57/293

(58) Field of Search ..... 57/284–290, 332, 57/333, 350, 908, 204, 205, 243–247, 293; 28/220, 221, 245, 247, 248, 263, 271

(56) References Cited

U.S. PATENT DOCUMENTS

| | | | | | |
|---|---|---|---|---|---|
| 3,534,540 | A | * | 10/1970 | Collingwood et al. | 57/239 |
| 4,004,329 | A | | 1/1977 | London, Jr. et al. | |
| 4,025,595 | A | | 5/1977 | Mirhej | |
| 4,218,869 | A | * | 8/1980 | Newton | 57/245 |
| 4,307,565 | A | * | 12/1981 | Sasaki et al. | 57/205 |
| 4,355,499 | A | * | 10/1982 | Takai | 57/205 |
| 4,355,592 | A | * | 10/1982 | Tajiri et al. | 112/410 |
| 4,365,466 | A | * | 12/1982 | Horiuchi et al. | 57/205 |
| 4,955,189 | A | * | 9/1990 | Yanagihara et al. | 57/207 |
| 5,175,038 | A | * | 12/1992 | Tung et al. | 428/92 |
| 5,462,790 | A | * | 10/1995 | Matsuki et al. | 442/195 |
| 5,613,285 | A | * | 3/1997 | Chester et al. | 28/247 |
| 5,804,115 | A | * | 9/1998 | Burton et al. | 264/103 |
| 6,240,609 | B1 | * | 6/2001 | Rasnick et al. | 28/258 |
| 6,332,253 | B1 | * | 12/2001 | Rasnick et al. | 28/258 |
| 6,401,315 | B2 | * | 6/2002 | Rasnick et al. | 28/258 |
| 2001/0025405 | A1 | * | 10/2001 | Rasnick et al. | 28/258 |
| 2002/0121011 | A1 | * | 9/2002 | Rasnick et al. | 28/258 |

FOREIGN PATENT DOCUMENTS

| | | | |
|---|---|---|---|
| EP | 0 848 095 | A | 6/1998 |
| EP | 0848095 | A1 * | 6/1998 |
| GB | 1 544 934 | A | 4/1979 |
| SU | 1 804 506 | A | 3/1993 |
| WO | WO 1 36725 | A | 5/2001 |
| WO | WO 01 64983 | A | 9/2001 |
| WO | wo-0136725 | A1 * | 5/2002 |
| WO | wo-0164983 | A1 * | 9/2002 |

OTHER PUBLICATIONS

Karhryn Hatch, Textile Science, 1993, West Publishing, 1st edition, p. 434.*

* cited by examiner

*Primary Examiner*—John J. Calvert
*Assistant Examiner*—Shaun R Hurley
(74) *Attorney, Agent, or Firm*—Miles & Stockbridge P.C.; John C. Kerins

(57) ABSTRACT

A process for combining singles yarns, of different colors or dyeabilities, to form an apparent twist yarn. The process includes the sequential steps of individually and simultaneously drawing and texturing a plurality of singles yarns; converging the drawn and textured singles yarns through an air jet entangler that simultaneously entangles and tensions the yarn bundle; twisting the singles yarns in the yarn bundle about each other in alternate, or otherwise patterned, S and Z directions.

29 Claims, 2 Drawing Sheets

APPARENT TWIST YARN SYSTEM AND APPARATUS AND METHOD FOR PRODUCING SAME

This application claims the benefit of Provisional Application No. 60/218,045, filed Jul. 13, 2000.

BACKGROUND OF THE INVENTION

1. Field of the Invention

The present invention relates to an apparatus for producing, and a continuous process for making yarns, in which said yarns are manufactured by processing together a number of singles yarns in such a manner as to result in a final yarn which, when used to manufacture a carpet, floor-covering or textile article, will result in the article having the appearance of being made using a fully twisted face yarn. The present invention additionally relates to yarns made using such a continuous process.

2. Description of Related Art

As used herein, certain terms have the meanings ascribed to them as follows: The terms "thread" and "filament" are intended to connote single filament fibers, whereas "singles yarn", "singles fiber" or "strand" is an assembly of two or more threads or filaments.

Undrawn, essentially unoriented, and partially oriented yarns (POY), melt-spun from thermoplastic polymers provide yarns which are described in the art as "flat", i.e., the filament bundles are essentially linear, and have little shape retention ability or resilience towards deforming forces. As such, these yarns have little utility in the field of carpet manufacture without further processing to improve these properties. A number of processes have been developed over the years in the fiber and carpet industries to provide tufting yarns with increased resilience, bulk, etc., by so-called "down-stream processing" of these yarns. Such processes, which largely consist of physical treatments to the as-spun singles yarns and/or collections of singles yarns brought together to produce higher filament count yarn bundles include, but are not limited to, drawing, (single or multi-stage), texturing, crimping and twisting.

As well as providing yarns with improved physical properties, and carpet backing covering ability, such processes have also been used to provide yarns with a wide range of aesthetic effects. This may be done, for example, by carrying out any or all of the above processes utilising two or more singles yarns in which the said singles yarns differ one from another in terms of dyeability, color, tensile properties, polymer types, cross-sectional shape, denier, or any combination of these. Processes of this type can provide the carpet designer with yarns which may be tufted into backing materials to manufacture carpets of widely ranging design and appearance, which ability would be expected to provide the manufacturer with a commercial advantage in the market-place.

One physical treatment or process which can provide yarns with an aesthetic appearance of particular desirability to the carpet designer is twisting, where singles yarns, particularly of different colors or dyeability, are cable twisted about each other in a spiral fashion. In theory, such a process can be used to provide various degrees of twist interval in the final bundled yarn product, and thus be capable of providing the designer with a number of options for producing a variety of visual effects in the final tufted carpet. However, true cable twisting of carpet denier yarns is difficult, slow and expensive to achieve, and even if achieved, requires that additional materials and processes be used to provide yarns and carpets in which said twist remains stable and unaltered over a period of time.

In order to be able to apply such appearance changes economically to yarns, it would be very useful to have a process which imparts the appearance of true twist to the yarns, without performing an actual cable twist operation. The process would, for economic reasons, be a continuous process, taking a plurality of undrawn, essentially unoriented, or POY singles yarns all the way through to a final, apparent twist, yarn. It would also be preferable to dispense with the need for the use of additional materials or processes in this continuous process, whose sole purpose is to "lock" the applied twist appearance effect in place and maintain said twist over time either in the yarn and/or in the ultimate carpet application.

Various disclosures have been made of processes proposed for producing "apparent twist" in carpet yarn, i.e., an appearance of twist, without performing a true twist. None has been commercially successful, whether it be because of technical deficiencies or the inability to process the carpet yarn economically. Several of these are discussed briefly below.

EP 007 563, (Teijin Limited), describes a cut-pile carpet yarn with randomly alternating S and Z false twist, (counter-clockwise and clockwise respectively). Yarn is false twisted in a single direction, heat-set to partially adhere the fiber bundle at node points, and allowed to "detwist". The last operation, due to the torque inherent in the twisted, heat-set yarn, results in the creation of alternate regions of S and Z twist in the final yarn. Heat-setting techniques, adding an additional step to the process, is required in order to stabilise the shape of the final yarn.

U.S. Pat. No. 3,775,955, (Bigelow-Sanford Inc.), claims an apparatus for the creation of a stable twisted yarn product in which individual singles yarns are simultaneously air-jet spun and twisted, and then combined by entanglement. Use of entanglement as a final process along the total length of the yarn does not result in the appearance effect desired in the present invention.

U.S. Pat. No. 4,051,660, (Akzona Inc.), describes a yarn, and a process for its manufacture, in which two or more previously crimped singles yarns are air jet twisted about each other in totally random S and Z directions. The random twist is present in very short lengths, and does not result in sections of the final yarn having a cable-twisted appearance.

U.S. Pat. No. 4,219,998, (Platt Saco Lowell Ltd.), describes a fluid jet twisting device for twisting strand with alternating S and Z directions. The device has two fluid inlets, and a control system which allows formation of vortices within the device, which, it is claimed will impart alternating twist to a yarn passing therethrough. The device is a stand-alone apparatus, and it is nowhere suggested that it may be used as part of a continuous yarn process starting with undrawn or POY singles yarns, and ending with an apparent twist bundled yarn.

U.S. Pat. No. 4,215,530, (ASA S.A.), is concerned with a process and apparatus in which a POY yarn is subjected to a supplementary, simultaneous drawing and twisting operation. Twist is imparted by a double twist rotating spindle, such that the tension inherent in this part of the process causes the required drawing of the yarn. The yarn is then heat set in an additional process step.

Several patents have issued to E. I. DuPont de Nemours and Company, (U.S. Pat. Nos. 4,873,821; 4,977,739; 5,003,763; 5,012,636; 5,179,827; 5,228,282; 5,465,566; 5,557,915; 5,577,376; 5,598,649; 5,644,909 and 5,829,241), on products, and apparatus and methods for their production, which feature alternate twist plied structures. In general these make alternate S and Z twist plied yarns from individual singles yarns by a process which includes the steps of tensioning the singles yarns as they move in a path through the process, twisting the individual yarns in either an S or Z direction, stopping the twisting operation, then bonding the ply twisted yarns at a node while applying twist, stopping the twisting operation, then repeating the procedure while twisting in the opposite direction. This constitutes a slow and mechanically complex procedure, and requires adhesive, melt, or ultrasonic bonding of the yarns to maintain the twisted configuration.

U.S. Pat. No. 4,949,440, (Belmont Textile Machinery Co., Inc.), describes a process and apparatus in which a previously plied yarn is entangled by an air jet, said air jet travelling with the yarn for a short distance within the entangling device such that the air impinges on only a short section of the yarn. Note that the plied yarn is supplied from a package, and is not passed to the entangling process from a twisting device set within a continuous process.

U.S. Pat. No. 5,263,308, (DuPont), illustrates a high speed ply twisting process utilising the technique known to those skilled in the art as "2 for 1" twisting. Use of such a mechanical twisting device is not envisaged in the present invention.

U.S. Pat. No. 5,284,009, (DuPont), exemplifies one solution to the problem, often encountered in the field of twisted yarns, of partial detwisting of the yarn after the twisting torque has been removed. Pile carpet yarns consisting of polyamide or polyester have included therein other fibers of lower melting point, e.g. polyolefins. Ply-twisted yarns of this type may be heat set in a conventional process, during which the polyolefin fibers melt-bond to each other and stabilise the twist in the yarn. This process again uses a heat setting step, and in addition contains extra filaments whose sole purpose is to stabilise the degree of twist imparted to the yarn.

U.S. Pat. No. 5,407,620, (BASF Corporation), describes a process wherein a twisted nylon yarn may be made directly as a continuous process from the melt spinning extruder. Fibers are spun from the extruder spin pack, combined into a yarn and carried through successive heating and cooling zones to a ceramic roller set at an acute angle to the filament path. Passing over said ceramic roller causes twisting of the fiber bundle back into the heating zone from where the twisted yarn passes to the cooling zone where the reduction in temperature is claimed to "freeze-in" the applied twist. The process is thus a continuous spin-draw-twist-setting-winding process. Note, however, that while the ceramic roller may be set to provide yarns with different degrees of twist, and different hands of twist, this cannot be used to alter S to Z twist while the process is running. Also this is a process for the manufacture of twisted singles yarns, and it would appear to be difficult and/or expensive to convert said process into one for dealing with a plurality of extruded singles yarns from a plurality of extruders. Combining already twisted singles yarns into a final yarn would, in any case, result in different yarn appearance to that envisaged in the present invention.

U.S. Pat. No. 5,613,285, (BASF Corporation), is concerned with processes for making multicolor multifilament non-commingled yarns. Two yarns are supplied separately to a drawing process, then to a false twist process together, then to a texturing process. Two of these bundles may then be ply twisted to a final yarn. Note that this method combines the starting singles yarns, and mixed yarns from these, in multiple combining steps throughout the process to provide the final yarn, rather than combining the starting singles yarns together at one point in the continuous process.

Caress Yarns Inc. have two patents, (U.S. Pat. Nos. 5,619,849 and 5,673,549), which describe a method and apparatus for forming a randomly variegated textile yarn by air jet twisting two or more yarns together in a randomly turbulent air device. A traversing drum after said air jet twisting device is set up in such a way as to have random inertial resistance, thereby creating randomly unpredictable take up of the yarn to produce non-uniform random twist in said yarns. While capable of producing final multicolored yarns with novel color effects, this approach does not provide control over the amount or degree of twist, the final product having totally random combination along its length of zero, S and Z twist. At no point either is it claimed that this process can be used as part of a continuous process to manufacture a twisted carpet yarns form a plurality of undrawn or POY singles yarns. In the second of the two patents, the inventor also specifically requires the use of an additional binder yarn spirally wrapped about the twisted yarn bundle.

U.S. Pat. No. 5,706,642, (issued to inventor Jack G. Haselwander), describes a mechanical twisting set-up in which two or more singles yarns may be twisted together in a pre-selected and changeable pattern as set by a programmable controller. The method and apparatus are applicable to any of the known mechanical yarn twisting methods, including cabling, "2 for 1" or ring-twisting, all of whose meanings and capabilities are well known to those skilled in the art. With the claimed use of a.c. or servo motors to drive the winders and twisting device, it is unlikely that the twist direction of the yarn could be easily changed from one hand to the other while the machine is running. Neither is it at any point claimed or implied that such a process could be used as a part of a continuous process to manufacture carpet yarns from a plurality of undrawn or POY singles yarns. In any case, such mechanical twisting devices are not envisaged as forming part of the present invention.

U.S. Pat. No. 5,715,584, (BASF Corporation), describes a yarn with a so-called "pixel" effect, i.e., the individual singles yarns which go to make up the bundled final yarn substantially retain their identity in the final entangled yarn product and thus their individual colors are visually perceptible. The process whereby this is achieved involves first individually interlacing at least two differently colored or dyeable singles yarns, then combining these together in an entanglement process. While an aesthetically useful yarn is provided in which individual colors are visually perceptible, (unlike the so-called "heather" yarns, where the perceived color is essentially an average of the colors of the singles yarns entangled together to make the final yarn), no twisting process is used, and carpets made using yarns produced via this process show completely different effect in a tufted pile carpet to that seen with true or apparent twist yarns.

U.S. Pat. No. 5,775,087, (Milliken Research Corp.), claims a process in which at least two differently colored singles yarns are separately air jet twisted, either in the same or different hand, then supplied together to a commingling air jet. The final yarn is said to exhibit zero net twist, and no one singles yarn predominates in terms of its color along the length of the product yarn. The process is in fact aimed at eliminating the known problem of "phasing" in the manufacture of cut pile plush fabrics, where such combined collage yarns have one component which is occasionally more perceptible than it should be.

U.S. Pat. No. 5,804,115, (BASF Corporation), describes a process in which, directly from the extruder, singles yarns of different colors are independently textured, then combined in an interlacer to yield a final yarn which, it is claimed, can be tufted directly into a carpet, "without further texturing or twisting". Practice of this invention results in a so-called "mock space-dyed" yarn. By this is meant a yarn made from different color singles yarns in which one color may predominate for random moderate lengths of said yarn and which, in visual appearance and in a carpet construction gives an effect similar to a true space-dyed yarn. Space-dyed yarns are those produced in a process of dyeing a white dyeable yarn in such a way that the color thereof varies randomly along the length of the yarn. The approach in this invention does not involve twisting of the yarn, nor does it provide the same aesthetic effects as are possible with a true or apparent twist yarn.

U.S. Pat. No. 6,023,926, (DuPont), is another patent claiming a method for the manufacture of a carpet yarn which simulates the appearance of a space-dyed yarn. The so-called "styling yarn" of the invention consists of two or more differently colored yarns false-twisted together, with a wrapper yarn spirally wound about this core yarn. False twist may be imparted to the core yarn by either a rotating hollow spindle apparatus, such as those commercially available from Suessen of Germany, or by an alternate twist ply jet as described in U.S. Pat. No. 5,179,827, (DuPont), referred to previously. It is stated in this document that there is no actual twist and substantially no intermingling between the singles yarns of the core, but rather a slight amount of false twist therebetween. This slight amount of false twist in the core results in low frequency alternation of the predominant color perceived in the final yarn along the length of said final yarn. Thus the product has the color attributes of a space-dyed yarn rather than a twisted yarn, both as a yarn, and in a carpet tufted therewith. The process and product also has the added complexity of requiring the wrapper yarn, whose sole function is to maintain the imparted configuration of the final yarn.

U.S. Pat. No. 6,052,983, (Belmont Textile Machinery Co., Inc.), claims an apparatus for inserting twist into a moving strand, said apparatus consisting of an assembly of units, each supplied with compressed air and having air channels therein communicating with the channel containing the said moving strand, set to direct air tangentially to the moving yarn in order to impart twist thereto. The number, size, and relative configuration of said units making up said apparatus may be varied in order to account for alteration of S and Z directions of twist, degree of twist, and yarn size. Production of twisted yarns via the apparatus claimed is achieved by inserting alternate S and Z directions of false twist into the singles yarns used to manufacture the final yarn, and stabilising said twist by "tacking" the twisted singles yarns via known methods, e.g., an air jet entangler. The inherent twist in the singles yarns results in spontaneous plying together of these yarns into a final yarn as they are brought into juxtaposition. Note that, in the case of this invention, the individual singles yarns are twisted before they are allowed to spontaneously ply together at a later stage in the process. It is also nowhere stated or implied that this apparatus could be used as part of a continuous process for the manufacture of apparent twist yarns from a plurality of undrawn or POY singles yarns.

Consideration of the extensive prior art summarised above has led to the conclusion that there still exists a need in the field of face yarns for use in tufted carpets, particularly loop-pile carpets, for a simple, economical process which would allow the in-line continuous manufacture of apparent twist yarns from a plurality of undrawn or POY singles feed yarns. Such a process would ideally eliminate the need for the use of slow mechanical twisting devices, would not require an expensive heat-setting stage, and would dispense with the use of fibers, besides the differently colored or dyeable singles yarns, whose sole purpose is to stabilise the twist imparted to the final product yarn.

In the course of extensive experimental study of methods of achieving apparent twist yarns, the inventors have discovered a process which meets the above criteria.

SUMMARY OF THE INVENTION

The present invention is concerned with a process for the manufacture of an apparent twist yarn for use in carpets, especially loop-pile tufted carpets, floorcoverings and textile articles. By "apparent twist" is meant a yarn which has the appearance, at least for major sections of its length, of being composed of two or more singles fibers or yarns, at least one of which is of a different color or dyeability to the others, which are spirally wound one about the other with a relatively tight spiral, giving a "barber-pole" like appearance. In said process, a plurality of undrawn or partially oriented, (POY), continuous filament singles yarns, at least one of which is of a different color or dyeability to the others are passed through the following sequence of treatments:

a) Drawing of each singles yarn separately and simultaneously;

b) Mechanical crimping of said drawn singles yarns;

c) Entangling of said drawn and crimped singles yarns separately and simultaneously;

d) Converging of said individually drawn, crimped and entangled singles yarns, and passing of the yarn bundle thus created through an air jet entangler and a pair of twist jets;

e) Conveying of stabilised apparent twist yarn to a take-up station.

The air jet entangler, also termed a bundle entangling jet, is designed such that the passageway through the body of the entangler through which the yarn bundle travels increases in cross-sectional dimension along the direction of travel of the yarn bundle. The two twisting jets are set up so as to impinge tangentially on the yarn bundle from opposite sides, thus imparting alternate regions of S and Z twist to the said yarn bundle. The aforementioned design of the bundle entangling jet will tend to retard the advancement of the bundle to the twisting jets, thereby imparting a tension on the strand, in addition to entangling the bundle. The tensioning of the yarn is believed to aid in making the twist being imparted by the twist jets of a more permanent character, thus eliminating the need for further processing steps in order to accomplish this twist permanence. This results in the production of a yarn with stable regions of alternating twist.

The present invention is further concerned with apparent twist yarns made via the above process.

DETAILED DESCRIPTION OF THE PREFERRED EMBODIMENT

Figure 1:
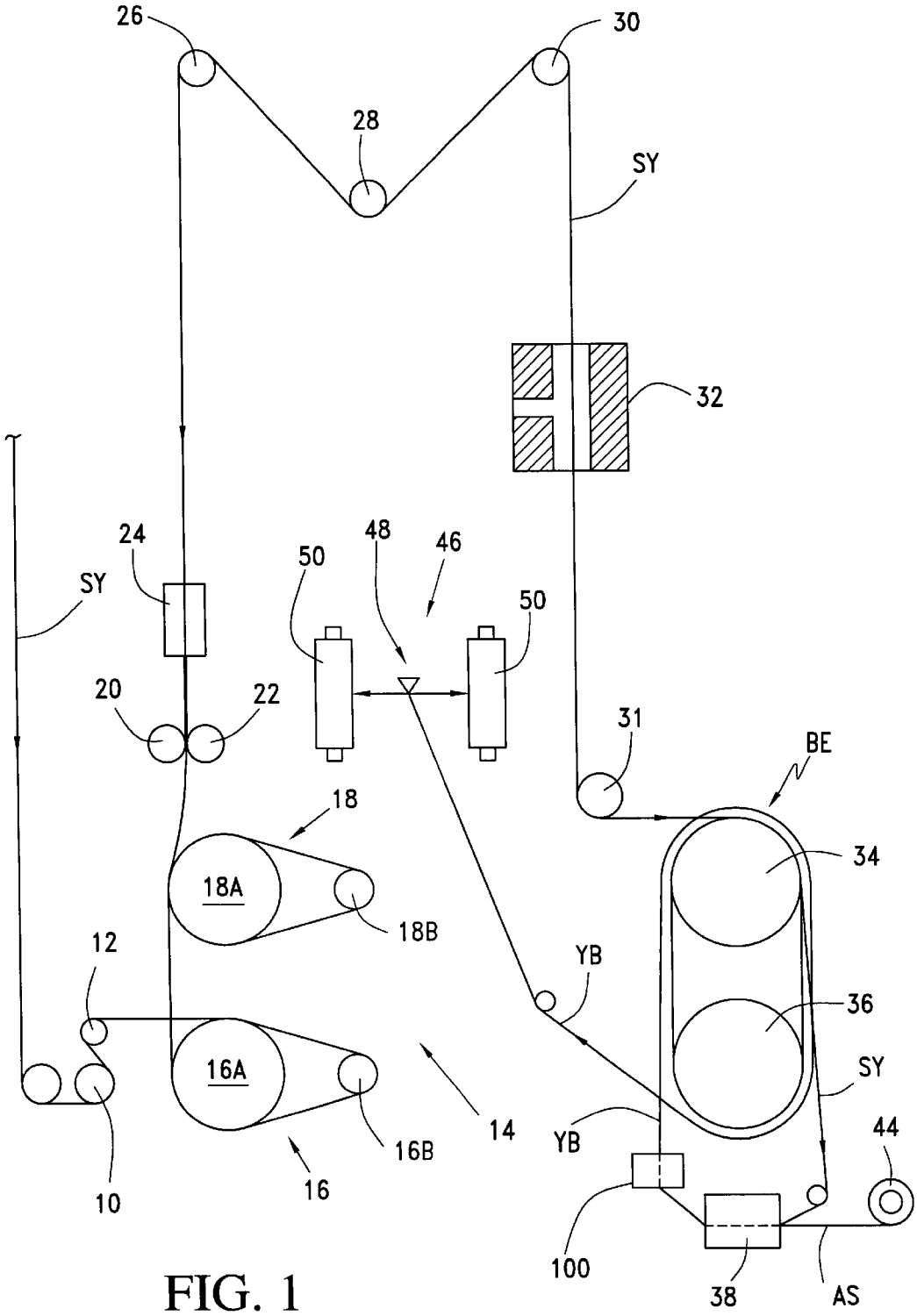
FIG. 1 is a substantially schematic drawing of the apparatus according to a preferred embodiment of the invention, showing the machine components and the threadpath of the yarn being produced.

In the FIG. 1 apparatus, two or more, and preferably between four and twelve polymeric continuous filament singles yarns SY, at least one of which is of a different color or dyeability to the others, are delivered from a package, (not shown), or other storage, to a pair of infeed rolls 10, 12, and then to a draw section 14 of the apparatus. The singles yarns are preferably undrawn or essentially unoriented, but partially oriented yarn, (POY), may be employed. The singles yarns SY travel from the infeed rolls to a first heat roll stage 16, consisting of rolls 16A and 16B, where the singles yarns are heated in a step in preparation for being drawn. The singles yarns are fed separately and simultaneously, and are looped or wrapped around heat roll 16A and roll 16B several times, preferably between 2 and 8 times, and most preferably 5 times. The heated singles yarns leaving first heat roll stage 16 are taken up in second heat roll stage 18. The pair of rolls 18A, 18B making up second heat roll stage 18, rotate at speeds faster than the corresponding rolls 16A and 16B of the first heat roll stage 16. As a result, drawing of the yarn takes place. The yarns SY are drawn at a ratio preferably in the range of about 2:1 to about 5:1, and even more preferably in the range of about 3:1 to about 4:1.

The temperature of the heated rolls will depend largely on the type of polymer from which the singles yarns have been manufactured, and the preferred temperatures will be readily understood by persons of ordinary skill in the art. Other means of heating the singles yarns may be used such as hot pins or plates, non-contact heaters, or hot gas such as nitrogen, air or steam. The suitability of each heating device will depend largely on the type of polymer employed for the singles yarn.

The drawn singles yarns SY are taken off the rollers of second heat roll stage 18 and proceed to a texturing section. As shown in FIG. 1, the texturing is preferably accomplished using a pair of co-rotating crimper wheels 20, 22, which produce a mechanical crimp by subjecting the singles yarns to frictional forces between the crimper wheels, as is well known in the art. It is to be noted that, while a mechanical crimping device is shown in the illustrated preferred embodiment, the texturing can be achieved by other known methods, such as by using air-jet texturing devices.

After passing through crimping wheels 20, 22, the singles yarns undergo tension control, for example, by passing through a doctor bar 24, and around a series of tension rolls 26, 28, 30. The tension control is preferably a tension adjustment that relaxes the singles yarns SY.

Figure 2:
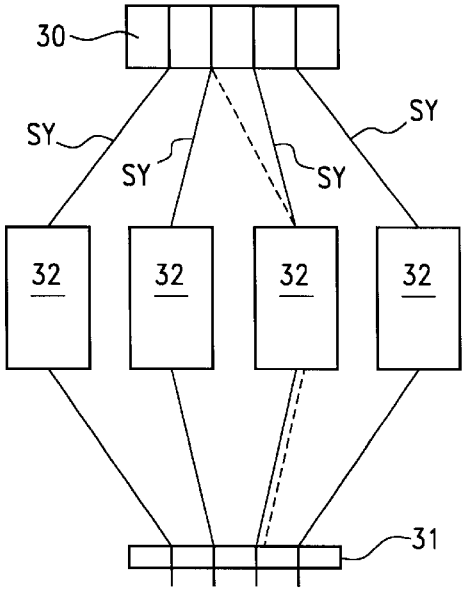
FIG. 2 is a substantially schematic illustration of a set of air-jet entanglers used to individually entangle the singles yarns being processed.

The singles yarns SY, upon exiting the tension control section, are preferably segregated or split out, and each is passed through an individual entangling device, shown schematically in FIG. 1 as an air-jet entangler 32, of a type known in the art, which tacks or entangles each singles yarn at regular, periodic intervals. FIG. 2 presents a schematic view showing four singles yarns coming off of the last tension roll 30, and being split out to four separate entanglers 32, and then rejoined at guide pin 31 for further processing.

Figure 3:
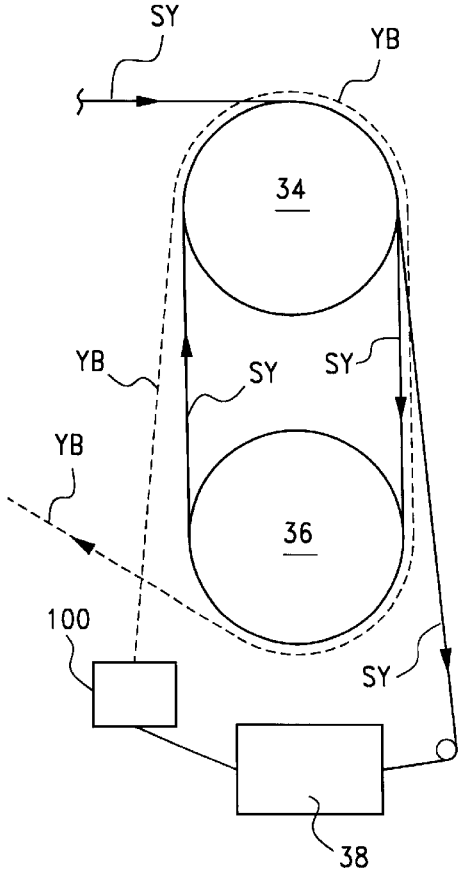
FIG. 3 is a substantially schematic illustration of the paths of travel of the yarns in and through the entanglement rolls, the main bundle entangler and the twist assembly.

The drawn, crimped, and individually entangled singles yarns SY are next transported to a bundle entangling section BE, which preferably comprises a pair of unheated entanglement control rolls or entanglement rolls 34, 36, and a main bundle entangling box or entangler 38. Having reference to FIG. 3 in conjunction with FIG. 1, it can be seen that the group of incoming singles yarns SY wrap to the back side of first entanglement control roll 34, and travel down to the back side of second entanglement control roll 36. The singles yarn SY travel up the front sides of the second and first entanglement control rolls, and wrap around the roll pair for a predetermined number of wraps, which may preferably be two wraps.

The entanglement control rolls are preferably stepped to present two or more different diameters or different lengths for the path of yarn travel. In that manner, the feed of these singles yarns SY can be controlled to provide various desired levels of underfeed or overfeed to the main bundle entangler 38.

Figure 4:
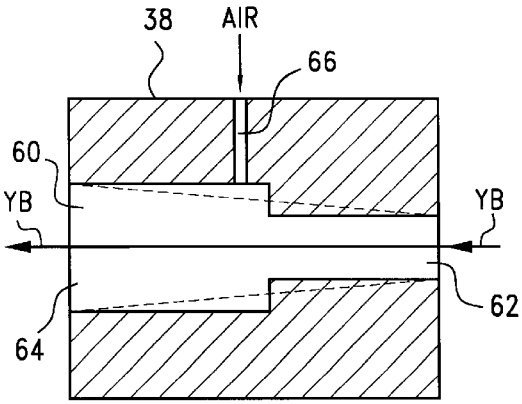
FIG. 4 is a substantially schematic cross-section view of the main bundle entangler according to a preferred embodiment of the present invention.

Upon completing the several wraps around the roll pair 34 and 36, singles yarns SY are sent to the main bundle entangling jet 38. The main bundle entangling jet 38 is set to produce repetitive, regular tacks in the yarn bundle passing therethrough. However, in a departure from the prior art, and causing effects that are distinctly different from the prior art, the air-jet entangler 38 is designed such that a smaller cross-sectional opening is provided at the yarn entrance side, and a larger cross-sectional opening is provided at a yarn exit end. This can best be seen in the schematical cross-section view of FIG. 4. In prior art entanglers, the larger opening is presented at the entrance, in order to accommodate the unmixed yarn bundle, and the smaller opening is provided at the exit, as the bundle is tighter after having been entangled. By reversing the position of the smaller and larger openings, the entangler tends to retard the forward travel of the yarn. In contrast, in the prior art design, with the larger opening at the entrance, the entangler works to aid in advancing the yarn. It was noted, in connection with the development of the present invention, that it was not possible to obtain an apparent twist yarn having the desired appearance and degree of permanence, when an entangler of the prior art design was used. The inner passageway 60 of the main bundle entangling jet preferably has two sections defining cylindrical openings of different diameters or cross-sections. The entangler 38 preferably employs the stepped internal configuration shown in solid lines, but may alternatively have a constant taper from the smaller entrance opening to the larger exit opening, as shown in broken lines. Compressed air is injected into section 64 in a direction substantially normal to a yarn bundle travel direction through injector port 66.

Also optionally introduced to the main bundle entangler 38 are one or more antistatic filaments AS. The filaments are fed to the bundle entangler by any known method, and are shown in FIG. 1 as being wound off of spool 44. The antistatic filaments are entangled with the singles yarns, and form part of the final yarn bundle YB.

After exiting the main bundle entangling jet, the yarn bundle YB is then conveyed to and through the twist jet assembly 100, in which two pairs of air jets are configured in such a way as to each supplied controlled intermittent pulses of compressed air to the fiber bundle tangentially thereto, in opposite directions, so as to impart alternate or otherwise programmed regions of S and Z twist to said yarn bundle. One of the pair of jets is disposed to have the compressed air impinge the fiber bundle tangentially on one side thereof, and the other pair is positioned to have the compressed air impinge upon opposing side thereof.

Figure 5:
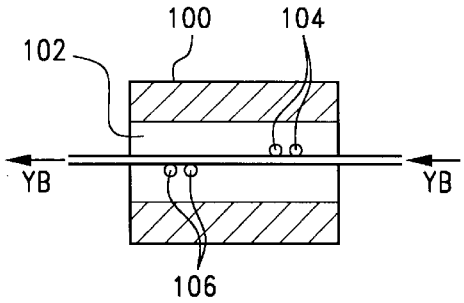
FIG. 5 is a substantially schematic cross-sectional view of the twist jet assembly illustrating the positions of the air inlets relative to the yarn bundle passing therethrough.

This can best be seen in FIG. 5, which shows the yarn bundle YB passing through the central opening 102 in the twist jet assembly. The first pair of air jets 104 is positioned to impart twist from a top, (as shown), side of the yarn bundle, and the second pair of air jets 106 is positioned to impart twist from a lower, (as shown), side of the yarn bundle, in a direction opposite that of the first pair of jets.

The sequencing of the intermittent pulses of compressed air to the twist jet assembly 100 are each controlled by electronic or electrical means using a programmable controller. Experimental processing to date has shown that with this particular design of the twist jet assembly 100 and the main bundle entangling jet 38, the apparent twisting of the yarn occurs not only in the twist jet assembly 100 itself, but also upstream of the twist jet assembly, and even upstream of the main bundle entangler 38, extending all the way back to the point where the yarns are taken off the entangling rolls to be sent through the main bundle entangler 38. Preferably, the air pressure to the twist jet assembly is regulated between a first high pressure and a second low pressure, each having a duration of between about 0.1 and 0.3 seconds, and most preferably of 0.2 seconds.

While not wishing to be limited to any theory as to how the invention specifically achieves its unique results, it is believed that the partially twisted yarns traveling from the entangling rolls to the main bundle entangling jet 38, are indeed entangled once reaching that point, and then are further subjected to twisting after the bundle entanglement. This is believed to impart more permanence and stability to the partially twisted yarns. The retardation and tensioning caused by the main bundle entangler does not significantly affect the onward conveying of the final yarn. The final apparent twist yarn product is then conveyed back over rolls 34 and 36, preferably wrapped once around each, and thence to a take-up section, shown schematically at 46, where the yarn bundle YB is directed or diverted by diverting means 48 to one of a plurality of spools 50. The take-up section may be selected from any of the variety of such devices known in the art.

As a result of the above described process, a final yarn is obtained which exhibits long sections of clearly defined, tightly spiralled "barber-pole" twist appearance in alternate, or otherwise patterned, S and Z directions, in which each of the differently colored singles yarns is spirally wound around the others and remains a coherent colored species, and which also has sections of entangled, (both twisted and untwisted), filaments in which the colors are largely mixed together. These entangled regions serve to maintain the twist imparted to the fibers in the yarn bundle along the yarn length, both in the produced apparent twist yarn and in carpets, floorcoverings or textile articles made therefrom. The stable twisted appearance of the final yarn is achieved without recourse to the use of additional wrapping yarns, adhesives etc., and without a need to submit the final yarn to an additional heat setting process to achieve such a stable twist-effect yarn. In addition, production speeds up to 1000 m/minute can be achieved without difficulty.

Any undrawn or essentially unoriented continuous filament polymeric singles yarns may be utilised in the practice of this invention. Further, as noted previously, the process may be useful for POY continuous filament polymeric singles yarns, as well. The singles yarns may be composed of, but not limited to, polyamides, polyesters or polyolefins. The singles yarns used in the invention may be all of the same polymer type or a combination of two or more different polymer types. Representative polymers of the polyester type which are well suited for use in this invention include poly(ethylene terephthalate) [PET], poly(propylene terephthalate) [PPT], poly(butylene terephthalate) [PBT], and copolymers and blends or mixtures thereof; a representative polymer of the polyolefin type is polypropylene. Of particular utility in the process of the invention are singles yarns whose polymeric matrix is largely composed of polyamide or copolyamide.

Polyamides and copolyamides are well known by the general term "nylon", and are long chain synthetic polymers containing amide (—CO—NH—) linkages along the main polymer chain. Suitable fiber-forming or melt spinnable polyamides of particular use in the practice of this invention include those which are obtained by the polymerisation of a lactam or an amino acid, or those polymers formed by the condensation of a diamine and a dicarboxylic acid. Typical polyamides include polyamide 6, polyamide 6:6, polyamide 6:10, polyamide 6:12, polyamide 6:T, polyamide 11, polyamide 12, sulfonated polyamides, copolymers, blends or mixtures thereof. Examples of suitable polyamide copolymers include those obtained by reacting one or more dicarboxylic acid components such as terephthalic acid, isophthalic acid, 5-sulphoisophthalic acid or its salts, adipic acid or sebacic acid with one or more diamine components such as hexamethylenediamine, m-xylylenediamine or 1,4-bis-aminoethylcyclohexane. The preferred polyamides are polyamide 6:6 or copolymers, blends or mixtures thereof; most preferred is a copolymer comprising components of adipic acid, the sodium salt of 5-sulphoisophthalic acid and hexamethylenediamine.

It is to be noted that polymer of any of the above-noted types obtained from reclaimed or recycled spun fibers, fabric or plastic scrap, or mixtures or combinations thereof, can advantageously be used in this process.

As the practice of this invention is aimed at the production of yarns with apparent twist color effects, it is necessary that at least one of the singles yarns which go to make up the final yarn is of a different color to, or has different dyeing properties to, the other singles yarns used in the construction of said yarn. It is preferred that the color difference required is achieved by using previously colored yarns, either dyed or melt pigmented, at the commencement of the process. It is also a preferred embodiment that each of the singles yarns used to manufacture the final yarn has a different color to all the others, e.g., where five singles yarns are combined into the final yarn, five different colors are used.

Due to their known improved color fade resistance and chemical cleaning agent resistance over dyed yarns in carpets, it is preferred that melt pigmented singles yarns, also known in the industry as "solution dyed" or "producer colored" yarns, are used in the practice of the present invention. Such yarns are melt spun, with the addition of one or more pigments, the pigments either being added directly, as single-pigment dispersions in carrier resins or as masterbatches of all pigments required to achieve the desired shade in a carrier resin. Processes to achieve this end are well known to those skilled in the art. The pigments used to color the said singles yarns may be selected from the categories of inorganic or organic pigments, or both. The singles yarns may also contain within their melt-extruded filaments other melt-added adjuvants, including but not limited to, antioxidants, UV stabilisers, antistatics, antimicrobials, process aids, stainblockers, anti-soiling agents and metal sequestering agents.

Optionally, the final yarn may have included therein, in addition to the above described colored singles yarns, filaments or singles yarns consisting of antistatic fibers.

The present invention is aimed at the manufacture of apparent twist yarns directly from undrawn, essentially unoriented, or POY singles yarns. Thus, those skilled in the art will readily appreciate which ranges of singles yarn deniers and deniers per filament will be required to result in suitable items of manufacture of this type.

The filaments making up the singles yarns used in the practice of the present invention may be of a variety of cross-sections including, but not limited to, round, delta, trilobal, tetralobal, "T", "H", or irregular. A preferred cross-sectional shape is trilobal.

The practice of the present invention is further illustrated by the following examples.

EXAMPLES 1–6

Five 1850/30Y (30 trilobal shaped filaments of total denier of 1850 g/9000 m), undrawn or essentially unoriented singles yarns were used as the starting materials for all of the examples of the inventive apparent twist process. All the singles yarns have a polyamide polymer matrix consisting of the components: sodium salt of 5-sulphoisophthalic acid, adipic acid and hexamethylenediamine. Each of the five singles yarns for each example was a different, melt-pigmented color selected from among known color formulations, and selected at the discretion of a designer to achieve desired coloration in the finished product. The singles yarn colors used in each example are shown in Table 1.

TABLE 1

| Example Number | 1st Singles Yarn Color | 2nd Singles Yarn Color | 3rd Singles Yarn Color | 4th Singles Yarn Color | 5th Singles Yarn Color |
|---|---|---|---|---|---|
| 1 | Black | Red | Apple Green | Bottle Green | Mauve |
| 2 | Black | Racing Green | Kelly Green | Butterscotch | Blue |
| 3 | Royal Blue | Black | Teal | Khaki | Light Blue |
| 4 | Black | Purple | Teal | Butterscotch | Off White |
| 5 | Black | Battleship Grey | Almond | Red Grape | Curry Yellow |
| 6 | Black | Antique Gold | Periwinkle | Shrimp Pink | Off White |

The five singles yarns were separately and simultaneously fed from their respective packages into the device illustrated in FIG. 1 via the infeed rolls 10, 12, and thence to the drawing section 14 defined by rollers 16A, 16B, 18A and 18B. The first heated roll 116A was set at 275° F., the second heat roll 18A at 340° F., and the singles yarns were separately and simultaneously drawn to a draw ratio of 3.6:1. The drawn singles yarns were then passed through the mechanical crimp rolls 20 and 22, through the doctor bar 24 to relax the drawn and crimped singles yarns, thence separately and simultaneously over the set of three tension rolls, with a tension setting of 125 g, to a set of entangling air jets 32 where the drawn and crimped singles yarns were separately and simultaneously air-jet entangled.

The drawn, crimped and entangled singles yarns were then passed around the pair of unheated entangling rolls 34 and 36 to a converging point at the main bundle entangling jet 38. The entangled, but unmixed, singles yarns were then passed through the main bundle entangling jet 38 and the twist jet assembly 100. The air supply settings of the jets were set at a pressure of 90 psi for the twist jets with an on-off cycle of two-tenths of a second, and a pressure of 80 psi was employed for the main bundle entangling jet. The positioning and design of the bundle entangling jet and the twist jets, and the control settings used therewith, resulted in twisting of the singles yarns over and around each other, and the locking-in of said twist. The main bundle entangling jet had an entrance section of 4 mm in diameter and an exit section of 6 mm in diameter. The product apparent twist yarn was then conveyed back over and around the rolls 34 and 36 thence to the take-up device 46.

For each example, the resulting product yarn was a 3000/150Y bulked continuous filament yarn (BCF), which exhibited the appearance of a true "barber-pole" twist along the majority of its length, interspersed with short regions of entangled filaments which served to stabilise said apparent twist. The yarns made via the process described in these examples were tufted into loop pile carpets which exhibited an appearance similar to carpets tufted with true-twist yarns. It is significant to note that untwisted regions in the final yarn were of such short duration compared to the alternating, or otherwise patterned, regions of twist, that these did not interfere with the appearance of carpets tufted using the yarns of the present invention.

A process for manufacture of apparent twist yarns, and apparent twist yarns made using such a process have been described above. Various details of the invention may be changed without departing from its scope. Furthermore, the foregoing description of the preferred embodiment of the invention and the examples provided are not to be construed as limiting the invention in any manner.

What is claimed is:

1. A process for the manufacture of apparent twist yarn comprising the steps of:

a) separately and simultaneously drawing a plurality of polymeric continuous filament singles yarns, at least one of which is of a different color or different dyeability to the others, b) crimping each of said plurality of drawn singles yarns, c) separately and simultaneously air-jet entangling said plurality of drawn and crimped singles yarns, d) converging said plurality of drawn, crimped and entangled singles yarns and conveying the thus formed unmixed yarn bundle through an air-jet entangler so constructed and arranged to, and so controlled to, intermittently entangle the singles yarns of the yarn bundle and simultaneously impart a retarding force on the yarn bundle tending to increase the tension on the yarn bundle, e) passing said yarn bundle through a twist jet assembly having first and second twisting air jets whose directions of air flow are each set to impinge tangentially on said yarn bundle in such a manner as to twist the component singles yarns of said yarn bundle about each other in alternate, or otherwise patterned, S and Z directions; and f) conveying the thus produced apparent twist yarn to a wind-up device.

2. The process of claim 1 wherein the air-jet entangler used to entangle the singles yarns of the yarn bundle and to simultaneously impart a retarding force on the yarn bundle has a yarn entrance section having a passageway therethrough which is smaller in size than a passageway through a yarn exit section.

3. The process of claim 1 wherein the step of passing the yarn bundle through a twist jet assembly further comprises controlling the pressurized air setting through the first and second twisting air jets in a repeating pressure sequence of high and low pressure.

4. The process of claim 3 wherein the said repeating pressure sequence is a repeating sequence of between 0.1 and 0.3 seconds high pressure and between 0.1 and 0.3 seconds low pressure, alternating between said first and second twisting air jets.

5. The process of claim 1, wherein said first and second twisting air jets each comprises a pair of twisting air jets.

6. The process of claim 1 wherein the said apparent twist yarn comprises between four and twelve polymeric continuous filament singles yarns.

7. The process of claim 1 wherein each of said polymeric continuous filament singles yarns making up said apparent twist yarn is of a different color.

8. The process of claim 1 wherein at least one of the plurality of polymeric continuous filament singles yarns is colored by melt pigmentation.

9. The process of claim 1 wherein at least one of the plurality of polymeric continuous filament singles yarns is a polyamide.

10. The process of claim 1 wherein at least one of the plurality of polymeric continuous filament singles yarns is a sulfonated polyamide.

11. The process of claim 1 wherein each of the plurality of said polymeric continuous filament singles yarn is selected from the group consisting of polyamide 6:6, polyamide 6, sulfonated polyamides, or copolymers, or blends or mixtures thereof.

12. The process of claim 1 further comprising feeding said plurality of polymeric continuous filament singles yarns at a singles yarn feed rate in a range of about 400 m/minute to about 1000 m/minute.

13. An apparent twist yarn manufactured by a process comprising the steps of:

a) separately and simultaneously drawing a plurality of polymeric continuous filament singles yarns, at least one of which is of a different color or different dyeability to the others, b) crimping each of said plurality of drawn singles yarns, c) separately and simultaneously air-jet entangling said plurality of drawn and crimped singles yarns, d) converging said plurality of drawn, crimped and entangled singles yarns and conveying the thus formed unmixed yarn bundle through an air-jet entangler so constructed and arranged to, and so controlled to, intermittently entangle the singles yarns of the yarn bundle and simultaneously impart a retarding force on the yarn bundle tending to increase the tension on the yarn bundle in its traverse path, e) passing said yarn bundle through a twist jet assembly having first and second twisting air jets whose directions of air flow are each set to impinge tangentially on said yarn bundle in such a manner as to twist the component singles yarns of said yarn bundle about each other in alternate, or otherwise patterned, S and Z directions to thereby produce an apparent twist yarn comprising alternate, or otherwise patterned, sections of S and Z twisted yarn interspersed with sections of non-twisted entangled filaments; and f) conveying the thus produced apparent twist yarn to a wind-up device.

14. The apparent twist yarn of claim 13 wherein the air-jet entangler used to entangle the singles yarns of the yarn bundle and to simultaneously impart a retarding force on the yarn bundle has a yarn entrance section having a passageway therethrough which is smaller in size than a passageway through a yarn exit section.

15. The apparent twist yarn of claim 13 wherein the step of passing the yarn bundle through a twist jet assembly further comprises controlling the pressurized air setting through the first and second twisting air jets in a repeating pressure sequence of high and low pressure.

16. The apparent twist yarn of claim 15 wherein the repeating pressure sequence is a repeating sequence of between 0.1 and 0.3 seconds high pressure and between 0.1 and 0.3 seconds low pressure, alternating between said first and second twisting air jets.

17. The apparent twist yarn of claim 13 further comprising between four and twelve polymeric continuous filament singles yarns.

18. The apparent twist yarn of claim 13 wherein each of said polymeric continuous filament singles yarns making up said apparent twist yarn is of a different color.

19. The apparent twist yarn of claim 13 wherein at least one of the plurality of polymeric continuous filament singles yarns is colored by melt pigmentation.

20. The apparent twist yarn of claim 13 wherein at least one of the plurality of said polymeric continuous filament singles yarn is a polyamide.

21. The apparent twist yarn of claim 13 wherein at least one of the plurality of polymeric continuous filament singles yarns is a sulfonated polyamide.

22. The apparent twist yarn of claim 13 wherein each of the plurality of said polymeric continuous filament singles yarns is selected from the group consisting of polyamide 6:6, polyamide 6, sulfonated polyamides, or copolymers, or blends or mixtures thereof.

23. Apparatus for making apparent twist yarn from a plurality of polymeric continuous filament singles yarns, at least one of which is of a different color or different dyeability to the others, comprising, in a single production line separate from a yarn spinning apparatus, a drawing device for drawing a plurality of yarns at a predetermined draw ratio;

a texturing device for individually and simultaneously texturing the plurality of yarns to obtain a plurality of textured yarns;

a first set of entanglers for individually and simultaneously entangling the plurality of textured yarns;

a second stage entangler for entangling the plurality of textured yarns to produce a yarn bundle and simultaneously imparting a retarding force on the said yarn bundle tending to increase the tension on the yarn bundle;

a twist jet assembly having first and second twisting air jets whose directions of air flow are each set to impinge tangentially on said yarn bundle in such a manner as to twist the component singles yarns of said yarn bundle about each other in alternate, or otherwise patterned, S and Z directions;

a programmable controller operably connected to said twist jet assembly and being so constructed and arranged to individually control the timing and degree of air flow to said first and second twisting air jets; and a wind-up device.

24. The apparatus of claim 23 wherein said second stage entangler has a yarn entrance section having a passageway therethrough which is smaller in size than a passageway through a yarn exit section.

25. The apparatus of claim 23 wherein said programmable controller comprises:

a control for controlling the air flow through the first twisting air jet to produce a first pressurized air setting of a repeating sequence of high and low pressure; and a control for controlling the air flow through the second twisting air jet to produce a second pressurized air setting of a repeating sequence of high and low pressure, wherein said second pressurized air setting is timed such that said second twisting air jet is at a high pressure when said first twisting air jet is at low pressure, and at a low pressure when the first twisting air jet is at a high pressure.

26. The apparatus of claim 25 wherein the timing of the said repeating sequence of high and low pressure is between 0.1 and 0.3 seconds high pressure and between 0.1 and 0.3 seconds low pressure.

27. The apparatus of claim 23 wherein said texturing device is a mechanical crimper texturing device.

28. The apparatus of claim 23 further comprising a feed rate control for controlling a singles yarn feed rate in a range of about 400 m/minute to about 1000 m/minute.

29. The apparatus of claim 23 wherein said apparatus is so constructed and arranged to process between four and twelve polymeric continuous filament singles yarns in producing said apparent twist yarn.

* * * * *